United States Patent [19]

Mitsuhashi et al.

[11] Patent Number: 4,590,140

[45] Date of Patent: May 20, 1986

[54] TONER APPLICATION METHOD AND TREATED MAGNETIC PARTICLES FOR USE THEREIN

[75] Inventors: Yasuo Mitsuhashi, Yokohama; Masanori Takenouchi, Urawa; Hatsuo Tajima, Matsudo; Masaki Uchiyama, Nakamachi; Motoo Urawa, Funabashi; Kenji Okado, Yokohama, all of Japan

[73] Assignee: Canon Kabushiki Kaisha, Tokyo, Japan

[21] Appl. No.: 658,779

[22] Filed: Oct. 9, 1984

[30] Foreign Application Priority Data

Oct. 19, 1983 [JP] Japan ..... 58-195603

[51] Int. Cl.[4] ..... G03G 13/08; G03G 13/09

[52] U.S. Cl. ..... 430/102; 430/122; 118/658; 222/403; 222/423; 222/DIG. 1; 427/25; 427/27

[58] Field of Search ..... 430/102, 122; 427/25, 427/27; 222/DIG. 1, 403, 423; 118/658

[56] References Cited

U.S. PATENT DOCUMENTS

| | | | |
|---|---|---|---|
| 4,337,724 | 7/1982 | Hosono et al. | 118/658 X |
| 4,365,586 | 12/1982 | Hosono et al. | 118/658 X |
| 4,385,829 | 5/1983 | Nakahata et al. | 430/122 X |

FOREIGN PATENT DOCUMENTS

| | | | |
|---|---|---|---|
| 56-69669 | 6/1981 | Japan | 430/122 |
| 57-99670 | 6/1982 | Japan | 118/658 |

*Primary Examiner*—Roland E. Martin

*Attorney, Agent, or Firm*—Fitzpatrick, Cella, Harper & Scinto

[57] ABSTRACT

A method for applying a toner comprising: forming, in a container containing a toner and magnetic particles for application of the toner, a magnetic brush of the magnetic particles; circulating the magnetic particles in the container; forming a thin layer of the toner electrically charged on the toner carrying member, wherein the magnetic particles have been treated with a substance A having a position opposite to that of the toner in the triboelectric series with the material constituting at least the surface of the toner carrying member as the standard substance and with a substance B having a position between the substance A and the toner in the triboelectric series.

10 Claims, 2 Drawing Figures

TONER APPLICATION METHOD AND TREATED MAGNETIC PARTICLES FOR USE THEREIN

BACKGROUND OF THE INVENTION

This invention relates to a toner application method for developing electrostatic latent images with a toner and magnetic particles for the toner application.

Conventionally, various types of apparatus have been proposed and put into practice as a dry type one-component developer apparatus. However, in any of those types, it has been very difficult to form a thin layer of one-component dry developer, so that a relatively thick layer of the developer is used. On the other hand, the recent desire for the improved sharpness, resolution or other qualities of developed images has necessitated the achievement of a system for forming a thin layer of one-component dry developer.

A method of forming a thin layer of one component dry developer has been proposed in Japanese Laid-Open Patent Application No. 43037/1979 and has been put into practical use. However, this method is directed to the formation of a thin layer of a magnetic developer, not of a non-magnetic developer. The particles of a magnetic developer must each contain a magnetic material in a large proportion to gain a magnetic property. This is disadvantageous since it results in poor image fixing characteristic when the developed image is heat-fixed on a recording paper to be transfer-printed. Further, because the magnetic material is generally black or dark-brown in color, it is difficult to obtain a clear color image by using a magnetic toner.

SUMMARY OF THE INVENTION

A principal object of the present invention is to provide a novel toner application method for obviating the above mentioned difficulties.

A further object of the present invention is to prevent a toner from leaking out of a developing apparatus by providing a toner with an appropriate amount of triboelectric charge.

These and other objects of the present invention are accomplished by a method for applying a toner comprising:

forming, in a container containing a toner and magnetic particles for application of the toner, a magnetic brush of the magnetic particles;

circulating the magnetic particles in the container; and forming a thin layer of the toner electrically charged on the toner carrying member, wherein the magnetic particles have been treated with a substance A having a position opposite to that of the toner in the triboelectric series with the material constituting at least the surface of the toner carrying member as the standard substance and with a substance B having a position between the substance A and the toner in the triboelectric series.

According to another aspect of the present invention, there are provided treated magnetic particles for applying a toner onto a toner carrying member or an image bearing member, comprising magnetic particles, a substance A having a position opposite to that of the toner in the triboelectric series with the material constituting at least the surface of the toner carrying member or the image bearing member as the standard substance, and a substance B having a position between the substance A and the toner in the triboelectric series.

DETAILED DESCRIPTION OF THE INVENTION

In practicing the present invention, there is used an image bearing member, which may be a member in the form of a drum or a belt having a layer of a photosensitive material and a layer of an insulating material. A rotating or circulating toner carrying member is further used. The toner carrying member may be in the form of a cylindrical sleeve or an endless belt made of a non-magnetic metal such as aluminum, copper, stainless steel or brass or a synthetic resin. The surface of the toner carrying member may be roughened or provided with unevenness pattern in order to improve the toner conveying performance or to enhance the triboelectrification characteristic. Inside the toner carrying member or on the opposite side of the toner carrying member with respect to the image bearing member, a magnet for forming a magnetic brush may be disposed. The magnet may be in the form of a roller or cylinder wherein a plurality of magnetic poles of the same or opposite polarities are formed along the extending direction of the roller or cylinder, or an assembly of plural bar-shaped magnets affixed onto a fixed supporting member. A regulating member may be provided as desired at the outlet of a developer container. The regulating member may be a blade or plate or a wall made of a magnetic material such as iron or a nonmagnetic material such as aluminum, copper or a resin.

The present invention will be explained hereinbelow by referring to the accompanying drawings.

Figure 1:
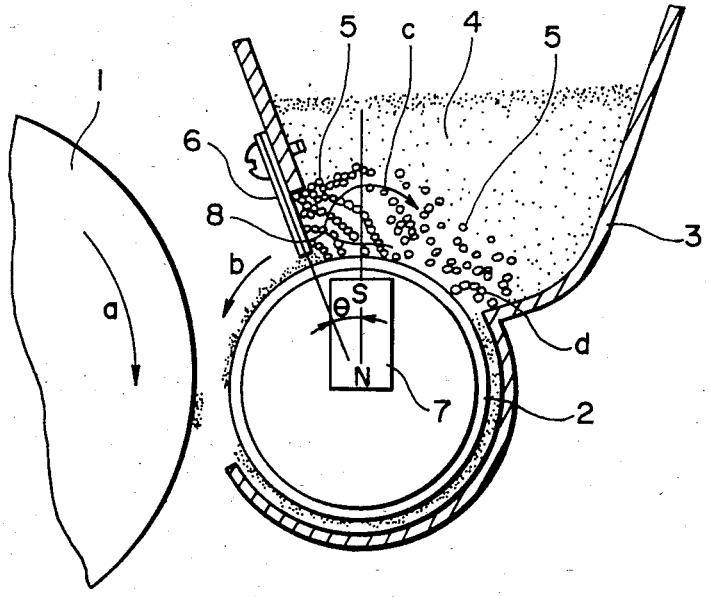
FIG. 1 shows a partial and schematic sectional view illustrating a developing apparatus for use in practicing the toner application method of the present invention.

FIG. 1 shows the cross-section of a developing apparatus to illustrate the principle of the development operation using the toner application method according to the present invention. The apparatus comprises an electrophotographic photosensitive drum 1 as a latent image bearing member which bears a latent image formed by an unshown latent image forming means. It is rotatable in the direction shown by arrow a passing through a developing station, where a non-magnetic sleeve 2, as a toner carrier for carrying a toner, is faced to the image bearing member with a predetermined gap or clearance. The sleeve 2 rotates in the direction shown by arrow b. Above the sleeve 2 is provided a container 3, made of a nonmagnetic material such as resin or aluminum, for containing a mixture of a toner 4 and magnetic particles 5. The container 3 has, at its downstream side with respect to movement of the sleeve 2, a magnetic blade 6 screwed to the container 3 as a means for regulating the supply of the toner to the developing station.

Across the sleeve 2 with respect to the magnetic blade 6 and inside the sleeve 2, a magnet 7 is provided. The position of the magnet 7 is determined in connection with the position of a magnetic pole S thereof and the position of the magnetic blade 6, and practically, the pole S is preferably positioned slightly upstream of the position of the magnetic blade 6. This arrangement provides better prevention of magnetic particle leakage through the clearance between the magnetic blade 6 and the sleeve 2 surface and better application of the toner onto the sleeve 2 surface.

In the above arrangement, the magnetic particles within the container 3 forms a magnetic brush by the magnetic field formed between the magnetic pole S of the magnet 7 and the magnetic blade 6. Upon rotation of the sleeve 2, magnetic particles and toner are mixed and stirred, while the magnetic brush 8 is kept formed. In the neighborhood of the magnetic blade 6, the mixture of toner and magnetic particles except for the portion of the toner passing through the magnetic blade 6 carried on the sleeve 2 is stopped by the magnetic blade 6 so that the mixture moves upwardly and circulates as shown by arrow c.

The toner is charged triboelectrically by the friction with the magnetic particles. The charged toner is uniformly applied onto the sleeve 2 by the image force as a thin layer of non-magnetic developer and conveyed to approach the photosensitive drum 1.

The magnetic particles constituting the magnetic brush 8 are prevented from going out through the clearance between the magnetic blade and the sleeve 2, by setting the confining force of the magnetic field by the magnet 7 to be larger than conveying force caused by the friction between the sleeve 2 and the magnetic particles. And, when the magnetic brush-forming region contains toner, the content of the toner in this brush region is maintained constant by the rotation of the sleeve 2. It is preferred to set the conditions so that the toner will be present in a proportion of 5 to 100 parts by weight, particularly 10 to 50 parts by weight, with respect to 100 parts by weight of the magnetic brush in the magnetic brush-forming region. Herein, the magnetic-brush forming region is defined as a region containing and enveloping the magnetic particles which are circulating under the constraint of the magnetic field in the container. Even when the toner is consumed by development, it is automatically compensated by the toner supplied to the region of the magnetic brush 8 due to the circulation of the magnetic brush. Thus, a constant amount of the toner is always applied onto the sleeve 2.

As will be apparent from the foregoing explanation, the magnetic particles are particularly important as a principal component of the present invention. The magnetic particles as a carrier material in the conventional two component developer wherein the magnetic particles are used in a much larger proportion than a toner, are required as a principal function to triboelectrically charge the toner and control the amount of the charge. On the contrary, the magnetic particles of the present invention are required to fulfill functions of forming a magnetic brush in a region where the toner is present in a much larger proportion than in the two component developer, applying the toner on the toner carrying member and regulating the amount thereof. The magnetic particles are further required to fulfill a function of supplying the toner while circulating. Furthermore, it is not desirable that the magnetic particles pass by the regulating member. In order to fulfill these functions, the magnetic particles must show an appropriate circulatability while being confined by a confining force exerted by a magnetic field and form a magnetic brush having appropriate hardness and density so as to allow uniform application of the toner. A relatively sparse magnetic brush is liable to result in streaks of excessive and scarse toner on the toner carrying member due to insufficient regulation. On the contrary, a dense magnetic brush is liable to give an extremely thin coating layer on the toner carrying member. Either case is not desirable. Further, when the magnetic particles show an excessive circulatability, too thick a coating layer is formed to cause fog on the resultant image. On the other hand, when they show insufficient circulatability, several defects are encountered such as occurrence of ghost.

As a result of our studies for obtaining magnetic particles satisfying the above mentioned several requirements, we have obtained a knowledge that the surface treatment of the magnetic particles for toner application is extremely important in addition to the particle size and its distribution of the magnetic particles.

As has been described hereinbefore, it is essential that the magnetic particles have been treated with a substance A having a position opposite to that of the toner in the triboelectric series with the material constituting at least the surface of the toner carrying member or, when the toner is directly applied to the image bearing member, the image bearing member as the standard substance and with a substance B having a position between the substance A and the toner. The magnetic particles of the present invention are required to fulfil essential functions of forming a magnetic brush in a system or container where the toner is present generally in a larger proportion than the magnetic particles and of applying the toner onto the toner carrying member or the image forming member, different from the carrier particles in the conventional two component developer where only the function of controlling the triboelectric charge of the toner is essentially required. In order to meet these requirements, the magnetic particles have to be treated with the above mentioned substances A and B in the present invention.

The magnetic particles should preferably be treated with 0.1 to 30 wt. %, particularly 0.5 to 20 wt. %, of the substances A and B in total with respect to the treated or coated magnetic particles of the present invention. Herein, the weight ratio of the substance A to the substance B should preferably be 10:90 to 99:1, more preferably 20:80 to 90:10 and most preferably 30:70 to 80:20. It is preferred that the substances A and B are respectively uniformly distributed over the magnetic particles.

Blank magnetic particles may be treated or coated with the substances A and B in a variety of methods such as a method wherein the substances A and B are mixed in powder form, melted or softened on heating and attached to the magnetic particles, a method wherein the substances A and B are dissolved or dispersed in a solvent and applied to be attached to the magnetic particles, and other methods known heretofore for treatment of carrier particles. More specifically, as a preferred method, the substances A and B may be dissolved or dispersed in an organic solvent such as methyl ethyl ketone or toluene, and the resultant solution or dispersion is applied by immersion or spraying onto the magnetic particles, which are then dried to form the treated magnetic particles of the present invention. Instead of an organic solution or dispersion, an emulsion of substances A and B may be used in a similar manner. The magnetic particles need not be treated simultaneously with the substances A and B. If an appropriate triboelectrically charging characteristic is imparted, the treatment can be effected sequentially.

The substances A and B may be selected depending on the materials constituting the toner carrying member and the toner. For example, when the toner carrying member is made of a metal such as aluminum or stainless steel and a positively chargeable toner is used, the substances A may, for example, be a fluorine-containing resin such as polytetrafluoroethylene, polymonochlorotrifluoroethylene, polyvinylidene fluoride, tetrafluoroethylene-ethylene copolymer, or tetrafluoroethylene-hexafluoropropylene copolymer, a silicone resin, a polyester resin, a metal complex of a monoazo dye or a metal complex of ditertiarybutylsalicylic acid; and the substance B may, for example, be a styrene resin, an acrylic resin, a polyamide, a silicone resin or polyvinyl butyral. When a negatively chargeable toner is used, the substance A may, for example, be nigrosine, aminoacrylate resin, an acrylic resin, a basic dye or a basic dye lake; and the substance B may, for example, be a styrene resin such as styrene-butyl acrylate copolymer, a silicone resin or a polyester resin. It should be noted, however, that the substances A and B are not restricted to the specific examples mentioned above. We now consider that the substance A has functions of providing a sufficient charge to the toner, of causing the magnetic particles to strongly taking up the toner therearound and of retarding the circulation of the magnetic brush, whereas the substance B has a function of controlling the functions of the substance A. When the magnetic particles are treated with the substance A or the substance B alone, it is difficult to control the triboelectric characteristic of the magnetic particles and further difficult to maintain the functions of the magnetic particles for a long period of time.

The blank magnetic particles for giving the treated magnetic particles for toner application of the present invention may, for example, be surface-oxidized or non-oxidized particles of a metal such as iron, nickel, cobalt, manganese, chromium or a rare earth metal, or an alloy of these, or particles of an oxide of these metals. The blank magnetic particles may preferably have a particle size of 50 to 200 microns, and no particular restriction is posed on the processes for production thereof.

On the other hand, the toner to be used in the present invention may comprise a binder resin of, for example, homopolymers of styrene and derivatives thereof such as polystyrene, poly-p-chlorostyrene, polyvinyltoluene, and the like; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-isoprene copolymer, styrene-acrylonitrile-indene copolymer, styrene-maleic acid copolymer, styrene-maleic acid ester copolymer, and the like; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenol resins, aliphatic or alicyclic hydrocarbon resins, aromatic petroleum resin, chlorinated paraffin, paraffin wax, etc. These binder resins may be used either singly or as a mixture.

As the colorant to be used in the toner, pigments or dyes known in the art such as carbon black, iron black, Phthalocyanine Blue, ultramarine, quinacridone, or Benzidine Yellow may be employed.

It is also possible to add, as a charge controlling agent, an amino compound, a quarternary ammonium compound or an organic dye, particularly a basic dye or its salt such as benzyldimethyl-hexadecyl ammonium chloride, decyl-trimethylammonium chloride, nigrosin base, nigrosine hydrochloride, Safranine γ, or Crystal Violet, a metal-containing dye, salicylic acid metal-containing compound, etc. Further, it is possible to add magnetic powder within such an extent that the effect of the invention is not hindered.

The above mentioned composition of the toner may be applicable to an ordinary developer obtained through the mixing-crushing method, or to either one or both of the wall material and core material of a microcapsule toner.

The toner application method of the present invention is preferably applied to a developing method wherein the thus formed layer of toner is caused to jump onto an image bearing member to develop the image on the image bearing member. In this case, the image bearing member is disposed to face the toner carrying member with a gap or clearance therebetween wider than the thickness of the applied toner layer formed on the toner carrying member.

The present invention will be described in further detail by referring to actual examples of practice. In the examples, parts are by weight.

EXAMPLE 1

Figure 2:
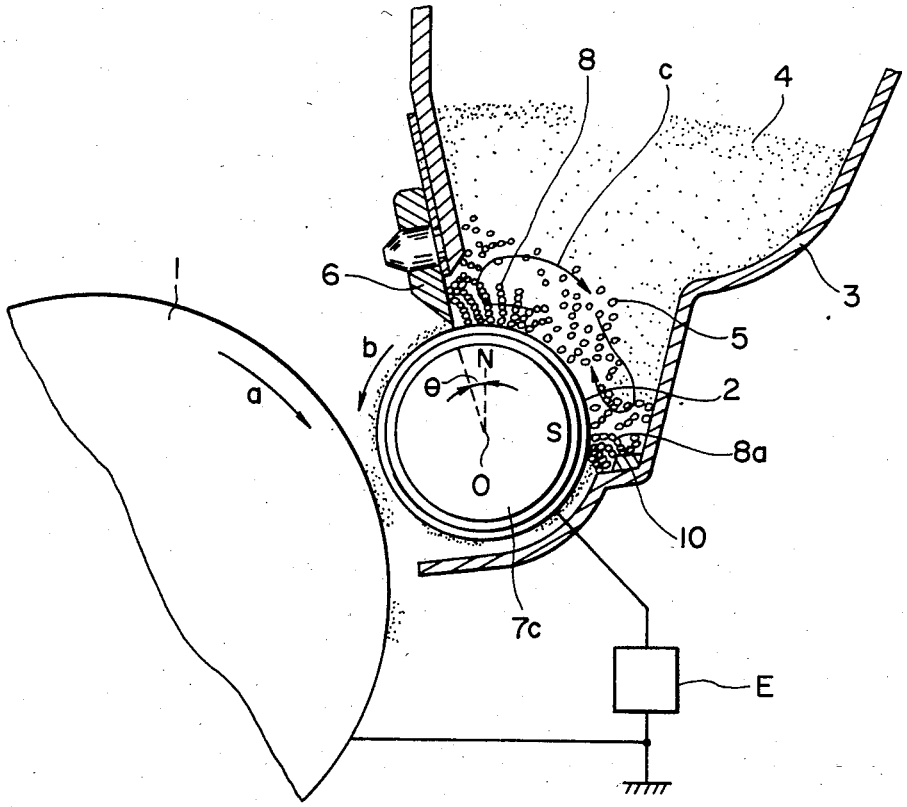
FIG. 2 shows a partial and schematic sectional view illustrating a developing apparatus used in actual examples of practice of the toner application method of the present invention.

The method of the present invention was practiced by using a developing apparatus as shown in FIG. 2. In FIG. 2, the same reference numerals denote substantially the same members as illustrated in FIG. 1.

In the apparatus shown in FIG. 2, a photosensitive drum 1 rotated at a peripheral speed of 60 mm/sec in the direction of arrow a. A sleeve 2 made of stainless steel (SUS 304) having an outer diameter of 32 mm and a thickness of 0.8 mm rotated in the direction of arrow b at a peripheral speed of 66 mm/sec. The surface of the sleeve 2 had been subjected to irregular shape sand blasting with alundum abrasive particles of 600 mesh pass and caused to have a roughness in the circumferential direction (Rz) of 0.8 micron. Inside the sleeve 2 was disposed a magnet 7*c* of a sintered ferrite type of which the first N pole was deviated toward inside of the container 3 by an angle (θ in the Figure) of 30° with respect to the line converting the tip of the magnetic blade 6 and the center of the sleeve 2.

The magnetic blade 6 was made of iron and the surface thereof was plated with nickel for prevention of staining. This blade 6 was disposed with a gap of 200 microns from the surface of the sleeve 2.

As the magnetic particles 5 were used irregular shape of iron particles (particle size: about 75 to 100 microns) treated with 5 wt. %, respectively, of aminoacrylate resin (M.W.: about 20,000; substance A) and butyl acrylate-styrene copolymer (copolymerization ratio: 10:90, M.W.: about 100,000; sustance B).

The toner 4 was provided as a cyan-colored negatively chargeable powder of 12 microns in average particle size obtained by mixing 100 parts of a polyester resin (M.W.: about 40,000, Softening point: 150° C.), 10 parts of a copper phthalocyanine pigment (C.I. Pigment Blue 15) and 5 parts of a negative charge controlling agent (alkylsalicylic acid metal complex), to which 0.5% of silica was externally added and mixed. The toner in an amount of 7 parts was well mixed with 50 parts of the magnetic particles and the mixture was charged into the container 3. Above the mixture was further added 200 parts of the toner. The circulation of the mixture of the toner and the magnetic particles in the container 3 was observed especially when the amount of the toner decreased.

In the above arrangement of developing apparatus, a layer of only the toner with about 80 microns-thickness was formed along with the rotation of the sleeve. The toner layer was subjected to the measurement of charged level by the blow-off method and found to be uniformly charged at the level of $-7.9$ $\mu c/g$.

On a photosensitive drum 1 facing the sleeve 2 with a gap of 300 microns was formed a charge pattern with a dark part of $+600$ V and a light part of $+150$ V. To the sleeve was applied an alternating voltage in a frequency of 800 Hz and with a peak-to-peak value of 1.4 kV and a central value of $+300$ V, whereby clear blue images of high quality were obtained without development irregularity, ghost image or fogging.

With respect to the mixture in the container 3, the magnetic particles were substantially not dissipated but the toner was selectively consumed. The developing function was stable without charge until most of the toner was consumed. After the toner was consumed, the development apparatus was taken out from the entire system and the lower part of the sleeve 2 was inspected, whereby no leakage of the magnetic particles nor even of the toner was observed.

EXAMPLE 2

The procedure of Example 1 was repeated with some modifications.

The gap between the blade 6 and the sleeve 2 was set at 100 microns. The magnetic particles comprised iron powder of irregular shape (about 75 to 100 microns) surface-treated with polytetrafluoroethylene (substance A, particle size of about 0.2 micron) and butyl acrylate-styrene copolymer (copolymerization ratio: 10:90, M.W.: about 100,000), respectively, in an amount of 6.4 wt. %. The toner 4 comprised powder of a mixture of 100 parts of a styrene-acrylic resin (copolymerization ratio: 70:30, M.W.: about 50,000), 10 parts of an azo pigment (C.I. Pigment Red 57) and 5 parts of an aminoacrylic resin (M.W.: about 20,000, Softening point: 100° C.), and 0.5 part of colloidal silica externally added and mixed therewith. Five parts of the toner and 50 parts of the magnetic particles were, after sufficient mixing, charged to the container 3, in which 200 parts of the toner was further charged. An organic photoconductor was used to form the photosensitive drum 1.

With the above modifications, the procedure of Example 1 was repeated, whereby the magnetic particles circulated properly to form a thin layer of only the toner on the surface of sleeve 2. By using this thin layer of toner, an electrostatic image on the photosensitive drum was developed, whereby an extremely good red developed image was obtained. The above developing operation was stable without change until most of the toner was consumed, with no occurrence of leakage of toner or magnetic particles to below the sleeve 2.

COMPARATIVE EXAMPLE 1

The procedure of Example 2 was repeated except that the butyl acrylate-styrene copolymer (substance B) was not used.

The developed images were good at the initial stage but, after repeating the copying operations, the circulation of the magnetic brush was retarded to result in decrease in image density. However, the leakage of the toner was little.

COMPARATIVE EXAMPLE 2

The procedure of Example 2 was repeated except that the polytetrafluoroethylene (substance A) was not used.

The developed images were good at the initial stage. However, after repeating the copying operations, the triboelectric charge between the magnetic particles and the toner decreased, fog occurred in the developed images, and leakage of the toner also occurred.

COMPARATIVE EXAMPLE 3

Example 2 was repeated except that the magnetic particles were used for the developing operation without any treatment.

The developed images were good at the initial stage. However, after repeating the copying operations, the circulation of the magnetic brush was retarded, and fog and decrease in density were observed in the resultant images.

EXAMPLE 3

Example 2 was similarly repeated except that iron powder of irregular shape (about 75 to 100 microns) was surface treated with 3 wt. % of polyvinylidene fluoride (M.W.: about 300,000, substance A) and 4 wt. % of methyl methacrylate-styrene copolymer (copolymn. ratio: 70:30, M.W.: about 140,000, compound B) to form magnetic particles 5, whereby good results were obtained without leakage of toner and decrease in image density.

EXAMPLE 4

On an organic photoconductor having an image bearing surface layer of methyl methacrylate-styrene copolymer (Copolymn. ratio: 80:20, M.W.: about 200,000), a negative electrical latent image was formed. The latent image was developed by brushing by means of an ordinary two component developing apparatus.

The developer was a two component developer comprising 4 parts of the toner used in Example 2 and 100 parts of treated magnetic particles obtained by treating iron powder of irregular shape (particle size: 75 to 100 microns) with 4 wt. % of polyvinylidene fluoride (substance A) and 3 wt. % of polymethylmethacrylate (substance B).

The latent image bearing member with a negative latent image was brushed with the developer to form a toner image, which was then electrostatically transferred onto a sheet and fixed thereon to give a clear red image.

EXAMPLE 5

Into 80 parts of methyl ethyl ketone, 5 parts of an aminoacrylate resin and 5 parts of butyl acrylate-styrene copolymer were dissolved. The resultant solution was sprayed onto iron powder of irregular shape (particle size: about 75–100 microns) and dried to obtain treated magnetic particles containing 5 wt. % of the aminoacrylate resin and 5 wt. % of the butyl acrylate-styrene copolymer.

What is claimed is:

1. A method for developing a latent electrostatic image comprising:

forming, in a container containing a toner and magnetic particles for application of the toner, a magnetic brush of the magnetic particles;

circulating the magnetic particles in the container; and forming a thin layer of the toner electrically charged on the toner carrying member, wherein the magnetic particles have been treated with a substance A having a position opposite to that of the toner in the triboelectric series with the material constituting at least the surface of the toner carrying member as the standard substance and with a substance B having a position between the substance A and the toner in the triboelectric series, and applying said thin layer of toner to develop said electrostatic image.

2. The method according to claim 1, wherein the magnetic brush is formed by the magnetism of a magnet disposed inside the toner carrying member.

3. The method according to claim 2, wherein the thickness of the toner layer is controlled by a toner-thickness regulating member.

4. The method according to claim 3, wherein the toner-thickness regulating member is a magnetic blade.

5. The method according to claim 1, wherein the toner carrying member comprises a sleeve or endless belt formed of a nonmagnetic material.

6. The method according to claim 5, wherein the nonmagnetic material is selected from the group consisting of aluminum, copper, stainless steel, brass or a synthetic resin.

7. The method according to claim 1, wherein the magnetic particles contains 0.1 to 30 wt. % thereof of the substances A and B in total.

8. The method according to claim 7, wherein the weight ratio of the substance A to the substance B is from 10:90 to 99:1.

9. The method according to claim 1, wherein the toner carrying member comprises a nonmagnetic metal; the toner is positively chargeable; the substance A is selected from the group consisting of a fluorine-containing resin, a silicone resin, a polyester resin, a metal complex of a monazo dye or a metal complex of ditertiary butylsalicylic acid; and the substance B is selected from the group consisting of styrene resin, an acrylic resin, a polyamide, a silicone resin or polyvinyl butyral.

10. The method according to claim 1, wherein the toner carrying member comprises a nonmagnetic metal; the toner is negatively chargeable; the substance A is selected from the group consisting of nigrosine, aminoacrylate resin, an acrylic resin, a basic dye or a basic dye lake; and the substance B is selected from the group consisting of a styrene resin, a silicone resin or a polyester resin.

* * * * *